United States Patent [19]

Giovanni et al.

[11] Patent Number: 4,709,510

[45] Date of Patent: Dec. 1, 1987

[54] FLOOR SANDING AND POLISHING MACHINE

[76] Inventors: Todescato Giovanni, Via Madonna, 29 - 36045 Lonigo (Vincenza); Conterno Giovanni, Via XXV Aprile, 3 - 36072 Chiampo (Vincenza), both of Italy

[21] Appl. No.: 818,765

[22] Filed: Jan. 14, 1986

[30] Foreign Application Priority Data

Jan. 22, 1985 [IT] Italy ..... 85503 A/85
Sep. 10, 1985 [IT] Italy ..... 22960/85[U]

[51] Int. Cl.[4] ..... B24B 23/02
[52] U.S. Cl. ..... 51/177; 15/98
[58] Field of Search ..... 51/177, 174; 15/49 R, 15/50 R, 87, 98

[56] References Cited

U.S. PATENT DOCUMENTS 1,000,696 8/1911 Schlueter ..... 51/177
1,069,803 8/1913 Nelson et al. ..... 51/177
1,928,390 9/1933 Myers ..... 51/177

FOREIGN PATENT DOCUMENTS 634301 2/1962 Italy ..... 15/98

*Primary Examiner*—Roscoe V. Parker
*Attorney, Agent, or Firm*—Finnegan, Henderson, Farabow, Garrett & Dunner

[57] ABSTRACT

A floor sanding and polishing machine is disclosed in which a plurality of heads carrying abrasive wheels are spring-mounted below a frame or body which is carried by a trolley in a height-wise adjustable manner. In this way the machine can be steered easily and without fatigue, and it is also possible for the working pressure to be adjusted mechanically and with precision in relation both to the material to be treated and the type of sanding wheel employed.

3 Claims, 3 Drawing Figures

FLOOR SANDING AND POLISHING MACHINE

The present invention relates to an improved floor sanding and polishing machine.

BACKGROUND OF THE INVENTION

As is well known to persons skilled in the art, machines of the kind in question, commonly known as floor sanding or resurfacing machines, consist structurally of a box-shaped body below which is mounted, with spring interposed, one or more heads to which sanding wheels are attached. An actuator motor is mounted on the body, which also has solid with it means hand-held by the operator in order to propel the floor sanding and polishing machine. Machines of this kind suffer from certain serious drawbacks: in the first place they are difficult to maneuver and call for much expenditure of effort on the part of the operator, who has to use them for an entire working day at a time, propelling them wherever required. Another drawback of such machines is that it is impossible to adjust their working pressure to parameters such as the quality of the material treated and the type of sanding wheel used, the degree and type of finish it is wished to obtain and the time allowed to obtain it.

Yet a further drawback of such known types of floor sanding machines is the difficulty—and often the impossibility—of treating corners, which the walls of the space the floor of which is being treated make it impossible to reach.

SUMMARY OF THE INVENTION

The object of the present invention is to embody a floor sanding machine in which the aforesaid problems are eliminated, or at least minimized.

To attain this object the sanding machine according to the present invention comprises a plurality of rotary heads spring-mounted below a body carrying the head-actuating means, wherein said body is in turn mounted on a trolley in a height-wise adjustable manner, registering means being to such end provided which act between body and trolley.

The registering means preferably consist of one or more screw bolt/nut screw linkages.

The structural and functional characteristics of the invention according to the present invention, and its advantages over the known art, will become more apparent from an examination of the following description thereof, referred to the appended drawings of an example of floor sanding machine according to the invention.

DETAILED DESCRIPTION OF THE INVENTION

Figure 1:
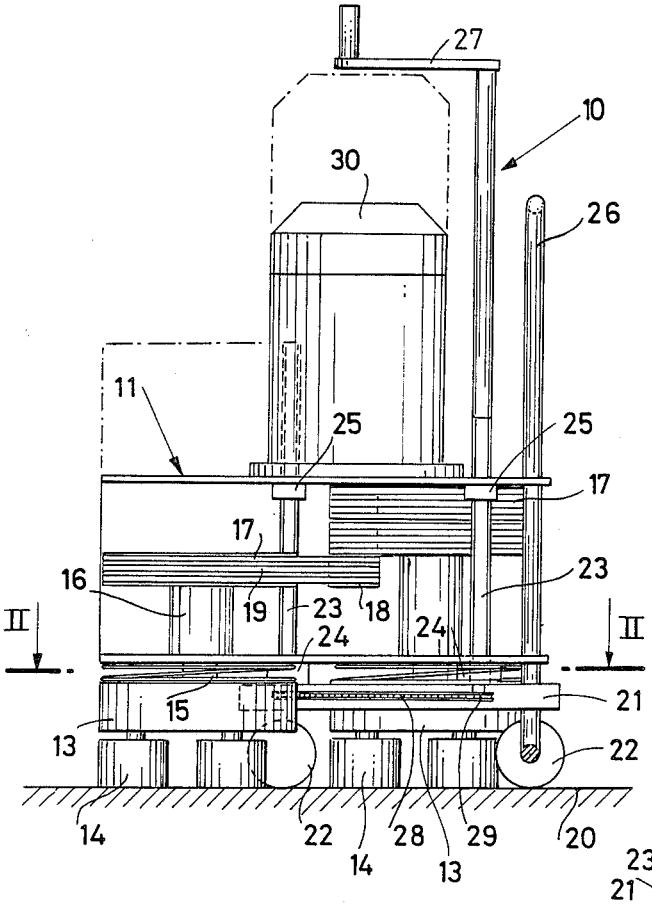
FIG. 1 is a partially transectional and sectional view taken through the line I—I of FIG. 2, illustrating the floor sanding machine according to the invention.

With reference to the drawings, the machine in question is indicated overall by 10, and consists structurally of a body 11 and a trolley 12.

The body 11 has a basically box-shaped structure and carries on its underside a plutality of sprung rotary heads 13, to each of which is secured a series of sanding wheels 14. The sprung heads 13 are conventional in structure, and this is therefore not here described in detail. It suffices to say that each head 13 is fixed to a shaft 15 mounted—in such a way as to allow rotation and axial translation—on a support 16.

In the example shown, the movement of the shafts 15 of the three heads 13 is transmitted by a single central drive unit through belt transmissions 17 and pulleys 18, 19, which are drive and driven pulleys respectively.

One aspect of the invention provides for the body 11 to be mounted on the trolley 12 in a height-wise adjustable manner with respect to the work surface 20. More exactly, in the illustrated example of a 3-headed floor sanding machine the trolley 12 has a characteristic structure comprising a low platform consisting of three spokes or divarications 21, disposed at an angle of 120°, at the ends of which idle wheels 22 are fitted. Extending vertically from the three spokes 21 are respective screw bolts 23 with which there cooperate nut screws 24 fixed to the lower part of the box-shaped body 11, between it and the trolley 12. The body 11 is in this way supported by the nut screws 24 and is traversed by the screw bolts 23 which are guided by means of bushes 25 secured to the upper wall of the body 11. One of the screw bolts 23, more exactly the one proximal to a haul and guide bar 26 of the trolley 12, extends upwards and features a crank 27 which controls its rotation. The rotation of this controlled screw bolt 23 is transmitted synchronously to the other screw bolts by means of a chain transmission 28 and pinions 29 keyed to the lower ends of the screw bolts 23. In the illustrated example of a 3-headed floor sanding machine, the drive pulleys 18 are moved by a single central drive unit 30 and all the heads rotate in the same direction, for instance the directions indicated by the arrows 31.

In the case of a floor sanding machine with a number of heads different from three, for example two or four, where the heads are intended to rotate in different directions, the use of more than one motor is provided for.

Figure 3:
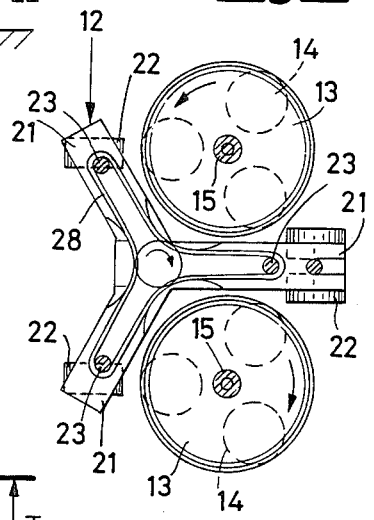
FIG. 3 is a schematic variant.

With a floor sanding machine having two heads rotating in opposite directions, the trolley with three spokes (FIG. 3) can advantageously be adopted.

The preceding description will have shown that, as the screw bolts 23 rotate in one or the other direction, the nut screws 24 will be caused either to ascend or to descend, which will in turn cause either the raising or lowering of the body 11 and thus of the sprung heads 13. In this way, the working pressure on the work surface 20, for example the floor of an interior space, will be varied.

Figure 2:
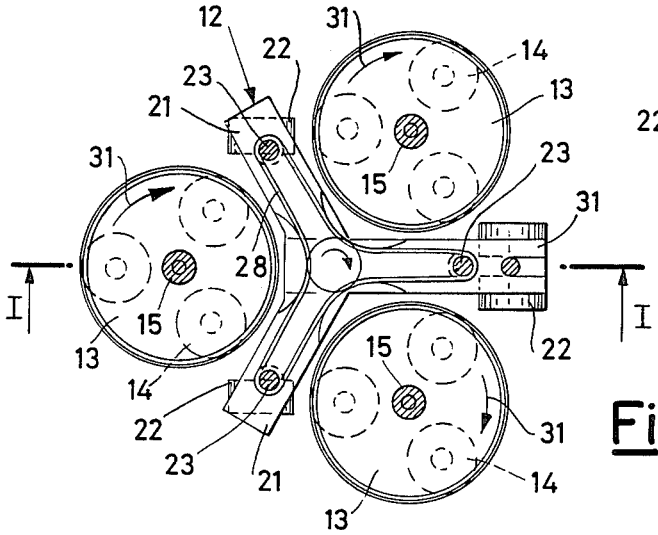
FIG. 2 is a sectional view taken through the line II—II of FIG. 1.

It will further be seen from FIG. 2 that the combination of a floor sanding machine with three heads mounted on a trolley having the characteristic 3-spoke structure heretofore described provides a perfectly symmetrical and balanced machine, which is thus very easily handled. Additionally, a triangular-plan machine design is obtained whereby each head is also enabled to operate in corners.

The objects stated in the preamble of the description are therefore attained.

From the foregoing description of preferred embodiments of the present invention, variations and modifications thereof, falling within the scope of the appended claims, will become apparent to one skilled in the art.

What is claimed is:

1. A floor sanding and polishing machine comprising:

(a) a trolley member comprising a low platform having three spoke members disposed at approximately 120° from each other for supporting said machine on a work surface;

(b) a body member positioned above said trolley member and having an upper wall and a lower wall;

(c) a plurality of rotary heads positioned below said body and spring-mounted thereon, said rotary heads being positioned between adjacent spoke members;

(d) actuator means mounted on said body and operatively connected to said heads to cause said heads to rotate;

(e) a plurality of bolt members extending vertically upward from said trolley member through said body member;

(f) a plurality of nut means fixed to said lower walls of said body and threadably engaged with said bolt members to adjustably support said body on said trolley;

(g) a plurality of bushing means secured to said upper wall of said body, said bolt members extending through said bushing means and being guided thereby;

(h) means for synchronously rotating said bolt members comprising an actuator crank mount on one of said bolt members; sprockets on said bolt members; and a chain transmission engaging said sprockets so that said bolt members are synchronously rotated when said crank is rotated to adjust the height of said body member relative to said trolley.

2. The machine of claim 1 wherein there are three of said rotary heads, each positioned between said spoke members, and said heads rotate in the same direction.

3. The machine of claim 1 wherein there are two of said rotary heads, each each positioned between said spoke members, and each head rotates in a different direction from the other.

* * * * *